US007417616B2

(12) United States Patent
Min et al.

(10) Patent No.: US 7,417,616 B2
(45) Date of Patent: Aug. 26, 2008

(54) INVERTER FOR LIQUID CRYSTAL DISPLAY

(75) Inventors: Woong-Kyu Min, Namyangju (KR); Hyeon-Yong Jang, Osan (KR)

(73) Assignee: Samsung Electronics Co., Ltd. (KR)

( * ) Notice: Subject to any disclaimer, the term of this patent is extended or adjusted under 35 U.S.C. 154(b) by 693 days.

(21) Appl. No.: 10/656,696

(22) Filed: Sep. 4, 2003

(65) Prior Publication Data

US 2004/0056825 A1 Mar. 25, 2004

(30) Foreign Application Priority Data

Sep. 4, 2002 (KR) ..... 10-2002-0053226
Nov. 8, 2002 (KR) ..... 10-2002-0069084

(51) Int. Cl.
*G09G 3/36* (2006.01)

(52) U.S. Cl. ..... 345/102; 315/291

(58) Field of Classification Search ..... 345/102; 315/291, 294, 295, 300
See application file for complete search history.

(56) References Cited

U.S. PATENT DOCUMENTS 5,844,540 A * 12/1998 Terasaki ..... 345/102
6,636,190 B2 * 10/2003 Hirakata et al. ..... 345/74.1
2002/0057247 A1 * 5/2002 Lee et al. ..... 345/88
2003/0137485 A1 * 7/2003 Wei et al. ..... 345/102
2003/0142118 A1 * 7/2003 Funamoto et al. ..... 345/691
2003/0178951 A1 * 9/2003 Park et al. ..... 315/312

FOREIGN PATENT DOCUMENTS

| | | |
|---|---|---|
| JP | 980377 | 3/1997 |
| JP | 2000111873 | 4/2000 |
| JP | 2001125547 | 5/2001 |
| JP | 2001166278 | 6/2001 |

OTHER PUBLICATIONS

JP2001166278 was cited in a Chinese Office action dated Aug. 31, 2007.

* cited by examiner

*Primary Examiner*—Sumati Lefkowitz
*Assistant Examiner*—Seokyun Moon
(74) *Attorney, Agent, or Firm*—Cantor Colburn LLP

(57) ABSTRACT

An inverter for a display includes; an inverter controller generating a carrier signal for pulse width modulation and a lamp driving signal having on-time and off-time by pulse width modulating a dimming signal based on the carrier signal and controlling the on-time of the lamp driving signal in response to at least one of a vertical synchronization signal and a vertical synchronization start signal from the signal controller, a power switching element transmitting a DC voltage in response to a signal from the inverter controller, and a voltage booster for driving a lamp in response to a signal from the switching element, wherein the inverter controller includes a control block which generates the carrier signal and the lamp driving signal, a time constant setting block which determines a time constant of the carrier signal, and an initiation block which resets the time constant given by the time constant setting block.

9 Claims, 17 Drawing Sheets

INVERTER FOR LIQUID CRYSTAL DISPLAY

BACKGROUND OF THE INVENTION (a) Field of the Invention

The present invention relates to an inverter for a liquid crystal display.

(b) Description of the Related Art

Display devices used for monitors of computers and television sets include self-emitting displays such as light emitting diodes (LEDs), electroluminescences (ELs), vacuum fluorescent displays (VFDs), field emission displays (FEDs) and plasma panel displays (PDPs) and non-emitting displays such liquid crystal displays (LCDs) requiring light source.

An LCD includes two panels provided with field-generating electrodes and a liquid crystal (LC) layer with dielectric anisotropy interposed therebetween. The field-generating electrodes supplied with electric voltages generate electric field in the liquid crystal layer, and the transmittance of light passing through the panels varies depending on the strength of the applied field, which can be controlled by the applied voltages. Accordingly, desired images are obtained by adjusting the applied voltages.

The light may be emitted from a light source such as a lamp equipped in the LCD or may be natural light. When using the equipped light source, the total brightness of the LCD screen is usually adjusted using an inverter by regulating the ratio of on and off times of the light source or by regulating the current through the light source. The latter has a problem that the lighting for low brightness is unstable since the lamp current flowing in the lamp is very small. Since the former easily controls the amount of light, i.e., the luminance of the lamp without such a problem, the former is preferred.

However, the former has a problem called water fall that horizontal stripes slowly move upward and downward on the LCD screen unless the on/off frequency of the lamp is exactly equal to multiples of a frame frequency, i.e., a driving frequency of the LCD panel. For example, water fall moving with a frequency of 5 Hz is generated on the screen when the frame frequency and the on/off frequency are 60 Hz and 65 Hz, respectively. This phenomenon is a kind of beating and can be perceivable by human eyes even though the difference between the frequencies is as small as 0.1 Hz.

SUMMARY OF THE INVENTION

A motivation of the present invention is to solve the problems of the conventional art.

According to an embodiment of the present invention, an inverter for a liquid crystal display is provided, which includes: an inverter controller generating a carrier signal for pulse width modulation and a lamp driving signal having on-time and off-time by pulse width modulating a dimming signal based on the carrier signal and controlling the on-time of the lamp driving signal in response to at least one of a vertical synchronization signal and a vertical synchronization start signal; a power switching element selectively transmitting a DC voltage in response to a signal from the inverter controller; and a voltage booster for driving a lamp in response to a signal from the switching element.

According to another embodiment of the present invention, an inverter for a liquid crystal display is provided, which includes: an inverter controller generating a lamp driving signal having on-time and off-time, a carrier signal for pulse width modulation in synchronization with a horizontal synchronization signal, and an oscillating signal by pulse width modulating a reference signal based on the carrier signal; a power switching element selectively transmitting a DC voltage in response to the oscillating signal from the inverter controller; and a voltage booster for driving a lamp in response to a signal from the switching element.

According to another embodiment of the present invention, an inverter for a liquid crystal display is provided, which includes: an inverter controller generating first and second carrier signals for pulse width modulation, a lamp driving signal having on-time and off-time by pulse width modulating a dimming signal based on the first carrier signal, and an oscillating signal by pulse width modulating a reference signal based on the second carrier signal, and controlling the on-time of the lamp driving signal in response to pulses of at least one of a vertical synchronization signal and a vertical synchronization start signal; a power switching element selectively transmitting a DC voltage in response to a signal from the inverter controller; and a voltage booster for driving a lamp in response to a signal from the switching element.

The liquid crystal display may include a signal controller for providing the vertical synchronization signal, the vertical synchronization start signal, and/or the horizontal and synchronization signal. The dimming signal is preferably provided from the signal controller or an external device.

The inverter controller preferably includes: a control block for generating the carrier signals, the lamp driving signal, and/or the oscillating signal; time constant setting blocks for determining time constants of the carrier signals; and initiation blocks for resetting the time constants given by the time constant setting blocks whenever pulses of the vertical synchronization signal and/or the horizontal synchronization signal are generated.

The time constant setting block preferably includes a resistor and a capacitor connected in series (between the dimming signal and a ground) and provides a signal at a node between the resistor and the capacitor to the control block.

One of the initiation blocks preferably includes a transistor by the pulses of the vertical synchronization signal and/or the horizontal synchronization signal. The transistor preferably has a collector connected to the node between the resistor and the capacitor of the time constant setting block, a grounded emitter, and a based supplied with the vertical synchronization signal via a resistor.

Another of the initiation block preferably includes a multivibrator regulating pulse width of the horizontal synchronization signal and/or the vertical synchronization signal and a diode connected in reverse direction from the multivibrator to the node between the resistor and the capacitor of the time constant setting block. The diode is turned on by the pulses of the vertical synchronization signal and/or the horizontal synchronization signal.

According to another embodiment of the present invention, an inverter for a liquid crystal display is provided, which includes: a triangular wave generator for generating a triangular wave using charging and discharging; a reset block for resetting the generation of the triangular wave by the triangular wave generator whenever the pulses of the vertical synchronization start signal; and a comparator for comparing a dimming signal with the triangular wave from the triangular wave generator and generating a pulse width modulated ("PWM") signal having on/off duty ratio.

The triangular wave generator preferably includes: a capacitor connected to a negative voltage for discharging path and providing an output voltage for the comparator; a first transistor for selectively providing a positive voltage for the capacitor; and a first operational amplifier for turning off the first transistor when the output voltage of the capacitor is equal to or larger than a predetermined value and turning on the first transistor when the output voltage of the capacitor is smaller than the predetermined value.

The reset block preferably includes a second transistor turned on to turn on the first transistor in response to the pulses of the vertical synchronization start signal.

The first transistor may include a pnp bipolar transistor and the second transistor may include an npn bipolar transistor.

The comparator preferably include a second operational amplifier comparing the dimming signal with the output voltage of the capacitor and outputting a high value when the dimming signal is lower than the output voltage of the capacitor and a low value when the dimming signal is higher than the output voltage of the capacitor.

The liquid crystal display may include a signal controller for providing the vertical synchronization start signal, and the dimming signal is provided from the signal controller or an external device. The inverter may further include: a power driver selectively transmitting a DC voltage in response to a signal from the comparator; and a voltage booster for driving a lamp in response to a signal from the switching element.

BRIEF DESCRIPTION OF THE DRAWINGS

The above and other advantages of the present invention will become more apparent by describing preferred embodiments thereof in detail with reference to the accompanying drawings in which.

DETAILED DESCRIPTION OF PREFERRED EMBODIMENTS

Figure 1:
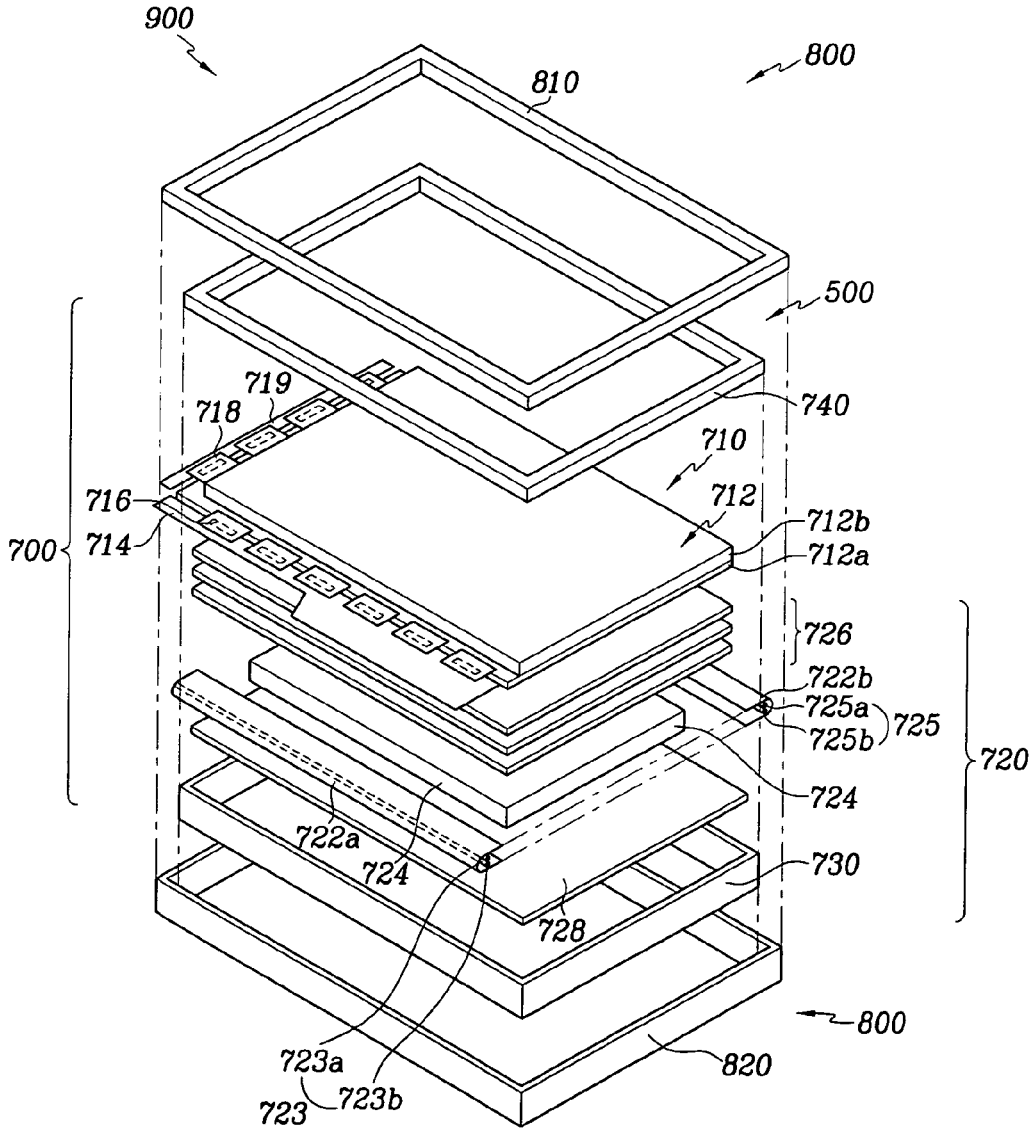
FIG. 1 is an exploded perspective view of an LCD according to an embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein. Like numerals refer to like elements throughout.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

Figure 2:
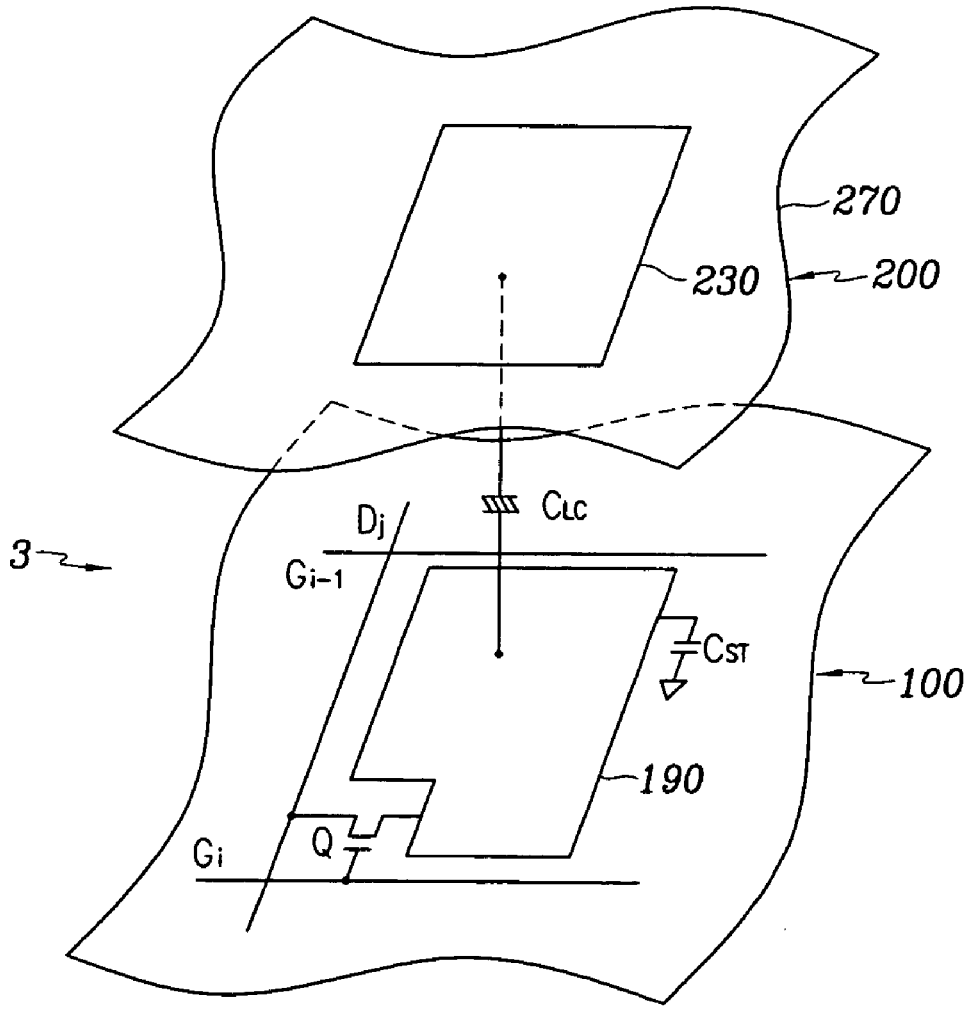
FIG. 2 is an equivalent circuit diagram of a pixel of an LCD according to an embodiment of the present invention.

FIG. 1 is an exploded perspective view of an LCD according to an embodiment of the present invention, and FIG. 2 is an equivalent circuit diagram of a pixel of an LCD according to an embodiment of the present invention.

In structural view, an LCD 900 according to an embodiment of the present invention includes a LC module 700 including a display unit 710 and a backlight unit 720, and a pair of front and rear cases 810 and 820, a chassis 740, and a mold frame 730 containing and fixing the LC module 700 as shown in FIG. 1.

The display unit 710 includes the LC panel assembly 712, a plurality of gate flexible printed circuit (FPC) films 718 and a plurality of data FPC films 716 attached to the LC panel assembly 712, and a gate printed circuit board (PCB) 719 and a data PCB 714 attached to the associated FPC films 718 and 716, respectively.

The LC panel assembly 712, in structural view shown in FIGS. 1 and 2, includes a lower panel 712*a*, an upper panel 712*b* and a liquid crystal layer 3 interposed therebetween while it includes a plurality of display signal lines $G_1$-$G_n$ and $D_1$-$D_m$ and a plurality of pixels connected thereto and arranged substantially in a matrix in circuital view shown in FIG. 2.

The display signal lines $G_1$-$G_n$ and $D_1$-$D_m$ are provided on the lower panel 712*a* and include a plurality of gate lines $G_1$-$G_n$ transmitting gate signals (called scanning signals) and a plurality of data lines $D_1$-$D_m$ transmitting data signals. The gate lines $G_1$-$G_n$ extend substantially in a row direction and are substantially parallel to each other, while the data lines $D_1$-$D_m$ extend substantially in a column direction and are substantially parallel to each other.

Each pixel includes a switching element Q connected to the display signal lines $G_1$-$G_n$ and $D_1$-$D_m$ and an LC capacitor $C_{LC}$ and a storage capacitor $C_{ST}$ that are connected to the switching element Q. The storage capacitor $C_{ST}$ may be omitted if unnecessary.

The switching element Q such as a TFT is provided on the lower panel 712*a* and has three terminals: a control terminal connected to one of the gate lines $G_1$-$G_n$; an input terminal connected to one of the data lines $D_1$-$D_m$ and an output terminal connected to the LC capacitor $C_{LC}$ and the storage capacitor $C_{ST}$.

The LC capacitor $C_{LC}$ includes a pixel electrode 190 on the lower panel 712*a*, a common electrode 270 on the upper panel 712*b*, and the LC layer 3 as a dielectric between the electrodes 190 and 270. The pixel electrode 190 is connected to the switching element Q and preferably made of transparent conductive material such as indium tin oxide (ITO) and indium zinc oxide (IZO) or reflective conductive material. The common electrode 270 covers the entire surface of the upper panel 712*a* and is preferably made of transparent conductive material such as ITO and IZO and supplied with a common voltage Vcom. Alternatively, both the pixel electrode 190 and the common electrode 270, which have shapes of bars or stripes, are provided on the lower panel 712*a*.

The storage capacitor $C_{ST}$ is an auxiliary capacitor for the LC capacitor $C_{LC}$. The storage capacitor $C_{ST}$ includes the pixel electrode 190 and a separate signal line (not shown), which is provided on the lower panel 712*a*, overlaps the pixel electrode 190 via an insulator, and is supplied with a predetermined voltage such as the common voltage Vcom. Alternatively, the storage capacitor $C_{ST}$ includes the pixel electrode 190 and an adjacent gate line called a previous gate line, which overlaps the pixel electrode 190 via an insulator.

For color display, each pixel represent its own color by providing one of a plurality of red, green and blue color filters 230 in an area occupied by the pixel electrode 190. The color filter 230 shown in FIG. 2 is provided in the corresponding area of the upper panel 712*b*. Alternatively, the color filter 230 is provided on or under the pixel electrode 190 on the lower panel 712*a*.

Referring to FIG. 1, the backlight unit 720 includes a plurality of lamps 723 and 725 disposed near edges of the LC panel assembly 712, a pair of lamp covers 722*a* and 722*b* for protecting the lamps 723 and 725, a light guide 724 and a plurality of optical sheets 726 disposed between the panel assembly 712 and the lamps 723 and 725 and guiding and diffusing light from the lamps 723 and 725 to the panel assembly 712, and a reflector 728 disposed under the lamps 723 and 725 and reflecting the light from the lamps 723 and 725 toward the panel assembly 712.

The light guide 724 is an edge type and has uniform thickness, and the number of the lamps 723 and 725 is determined in consideration of the operation of the LCD. The lamps 723 and 725 preferably include fluorescent lamps such as CCFL (cold cathode fluorescent lamp) and EEFL (external electrode fluorescent lamp). An LED is another example of the lamp 723 and 725.

A pair of polarizers (not shown) polarizing the light from the lamps 723 and 725 are attached on the outer surfaces of the panels 712*a* and 712*b* of the panel assembly 712.

Now, an LCD and an inverter therefor according to an embodiment of the present invention are described in detail with reference to FIGS. 3-6.

Figure 3:
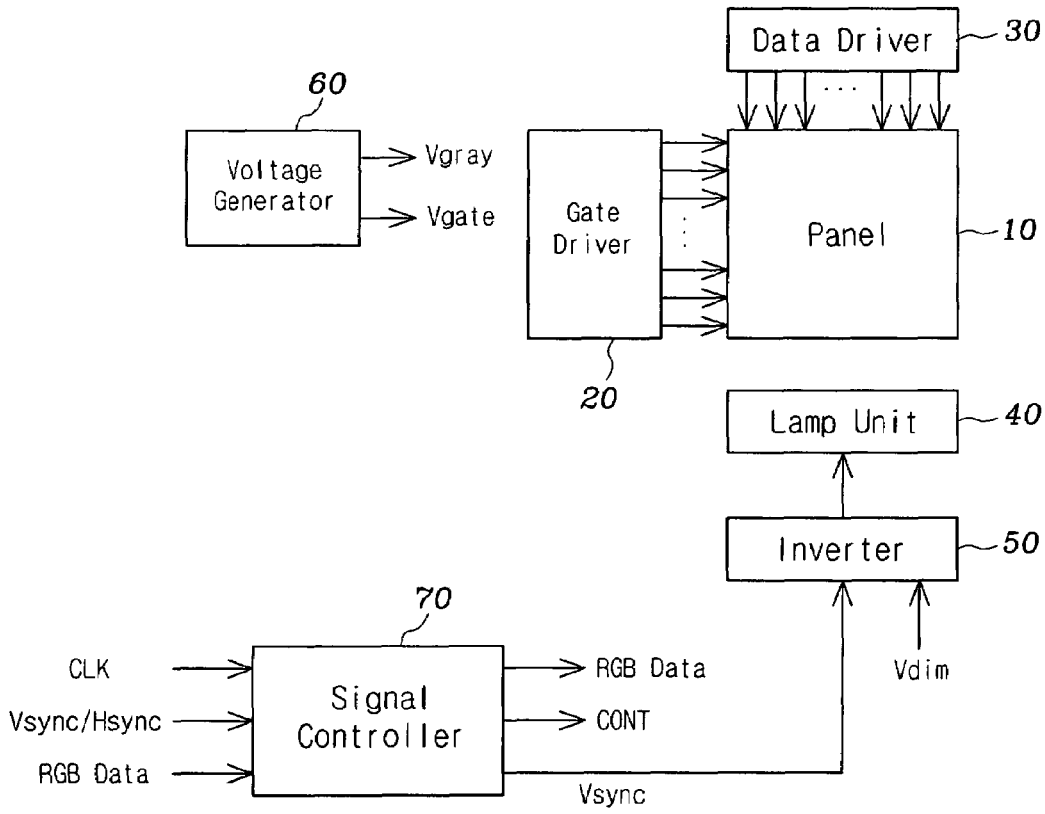
FIG. 3 is a block diagram of an LCD according to an embodiment of the present invention.

FIG. 3 is a block diagram of an LCD according to an embodiment of the present invention.

Referring to FIG. 3, an LCD according to an embodiment of the present invention includes a LC panel assembly 10, a gate driver 20 and a data driver 30 which are connected to the panel assembly 10, a voltage generator 60 connected to the gate driver 20 and the data driver 30, a lamp unit 40 for illuminating the panel assembly 10, an inverter 50 connected to the lamp unit 40, and a signal controller 70 controlling the above elements.

The lamp unit 40 and the liquid crystal panel assembly 10 shown in FIG. 3 are indicated by reference numerals 723 and 725 (the lamps) and 712 in FIG. 1, respectively. The inverter 50 may be mounted on a stand-alone inverter PCB (not shown) or mounted on the gate PCB 719 or the data PCB 714.

Referring to FIGS. 1 and 3, the voltage generator 60 generates a plurality of gray voltages Vgray related to the transmittance of the pixels and a plurality of gate voltages Vgate and is provided on the data PCB 714. The gray voltages Vgray includes two sets of gray voltages, and the gray voltages in one set have a positive polarity with respect to the common voltage Vcom, while those in the other set have a negative polarity with respect to the common voltage Vcom. The gate voltages Vgate include a gate-on voltage and a gate-off voltage.

The gate driver 20 preferably includes a plurality of integrated circuit (IC) chips mounted on the respective gate FPC films 718. The gate driver 20 is connected to the gate lines $G_1$-$G_n$ of the panel assembly 10 and synthesizes the gate-on voltage and the gate-off voltage from the voltage generator 60 to generate gate signals for application to the gate lines $G_1$-$G_n$.

The data driver 30 preferably includes a plurality of IC chips mounted on the respective data FPC films 716. The data driver 30 is connected to the data lines $D_1$-$D_m$ of the panel assembly 10 and applies data voltages selected from the gray voltages Vgray supplied from the voltage generator 60 to the data lines $D_1$-$D_m$.

According to other embodiments of the present invention, the IC chips of the gate driver 20 and/or the data driver 30 are mounted on the lower panel 712*a*, while one or both of the drivers 20 and 30 are incorporated along with other elements into the lower panel 712*a*. The gate PCB 719 and/or the gate FPC films 718 may be omitted in both cases.

The signal controller 70 controlling the drivers 20 and 30, etc. is provided on the data PCB 714 or the gate PCB 719.

Now, the operation of the LCD will be described in detail.

The signal controller 70 is supplied with RGB image signals RGB Data and input control signals controlling the display thereof such as a vertical synchronization signal Vsync, a horizontal synchronization signal Hsync, a main clock MCLK, and a data enable signal DE, from an external graphic controller (not shown). After generating a plurality of control signals CONT and processing the image signals RGB Data suitable for the operation of the panel assembly 10 on the basis of the input control signals and the input image signals RGB Data, the signal controller 70 provides the control signals CONT for the gate driver 20 and the data driver 30, and the processed image signals RGB Data for the data driver 30.

The control signals CONT include a vertical synchronization start signal STV for informing of start of a frame, a gate clock signal CPV for controlling the output time of the gate-on voltage, and an output enable signal OE for defining the width of the gate-on voltage. The control signals CONT further include a horizontal synchronization start signal STH for informing of start of a horizontal period, a load signal LOAD or TP for instructing to apply the appropriate data voltages to the data lines $D_1$-$D_m$, an inversion control signal RVS for reversing the polarity of the data voltages (with respect to the common voltage Vcom) and a data clock signal HCLK.

The data driver 30 receives a packet of the image data RGB Data for a pixel row from the signal controller 70 and converts the image data RGB Data into the analog data voltages selected from the gray voltages Vgray supplied from the voltage generator 60 in response to the control signals CONT from the signal controller 70.

Responsive to the control signals CONT from the signal controller 70, the gate driver 20 applies the gate-on voltage from the voltage generator 60 to the gate line $G_1$-$G_n$, thereby turning on the switching elements Q connected thereto.

The data driver 30 applies the data voltages to the corresponding data lines $D_1$-$D_m$ for a turn-on time of the switching elements Q (which is called "one horizontal period" or "1H" and equals to one periods of the horizontal synchronization signal Hsync, the data enable signal DE, and the gate clock signal CPV). Then, the data voltages in turn are supplied to the corresponding pixels via the turned-on switching elements Q.

The difference between the data voltage and the common voltage Vcom applied to a pixel is expressed as a charged voltage of the LC capacitor $C_{LC}$, i.e., a pixel voltage. The liquid crystal molecules have orientations depending on the magnitude of the pixel voltage.

In the meantime, the inverter 50 turns on and off the lamp unit 40 based on a dimming signal Vdim from an external source or the signal controller 70 and the vertical synchronization signal Vsync from the signal controller 70.

The light from the lamp unit 40 passes through the liquid crystal layer 3 and varies its polarization according to the orientations of the liquid crystal molecules. The polarizers convert the light polarization into the light transmittance.

By repeating this procedure, all gate lines $G_1$-$G_n$ are sequentially supplied with the gate-on voltage during a frame, thereby applying the data voltages to all pixels. When the next frame starts after finishing one frame, the inversion control signal RVS applied to the data driver 30 is controlled such that the polarity of the data voltages is reversed (which is called "frame inversion"). The inversion control signal RVS may be also controlled such that the polarity of the data voltages flowing in a data line in one frame are reversed (which is called "line inversion"), or the polarity of the data voltages in one packet are reversed (which is called "dot inversion").

Figure 4:
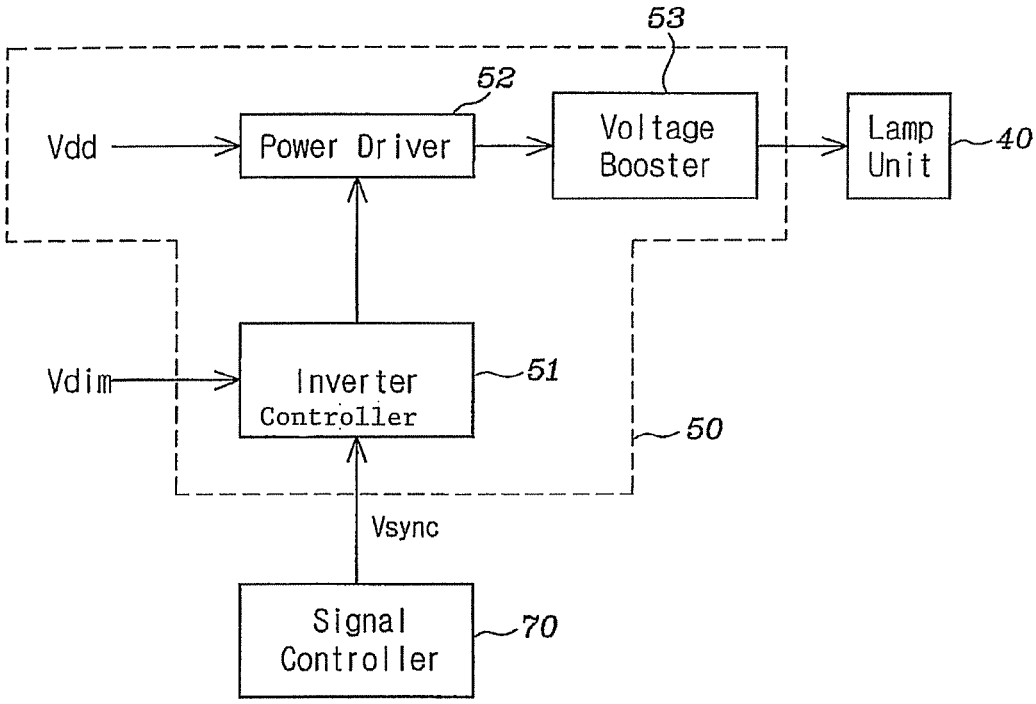
FIG. 4 is a block diagram of an exemplary inverter for the LCD shown in FIG. 3.
Figure 5:
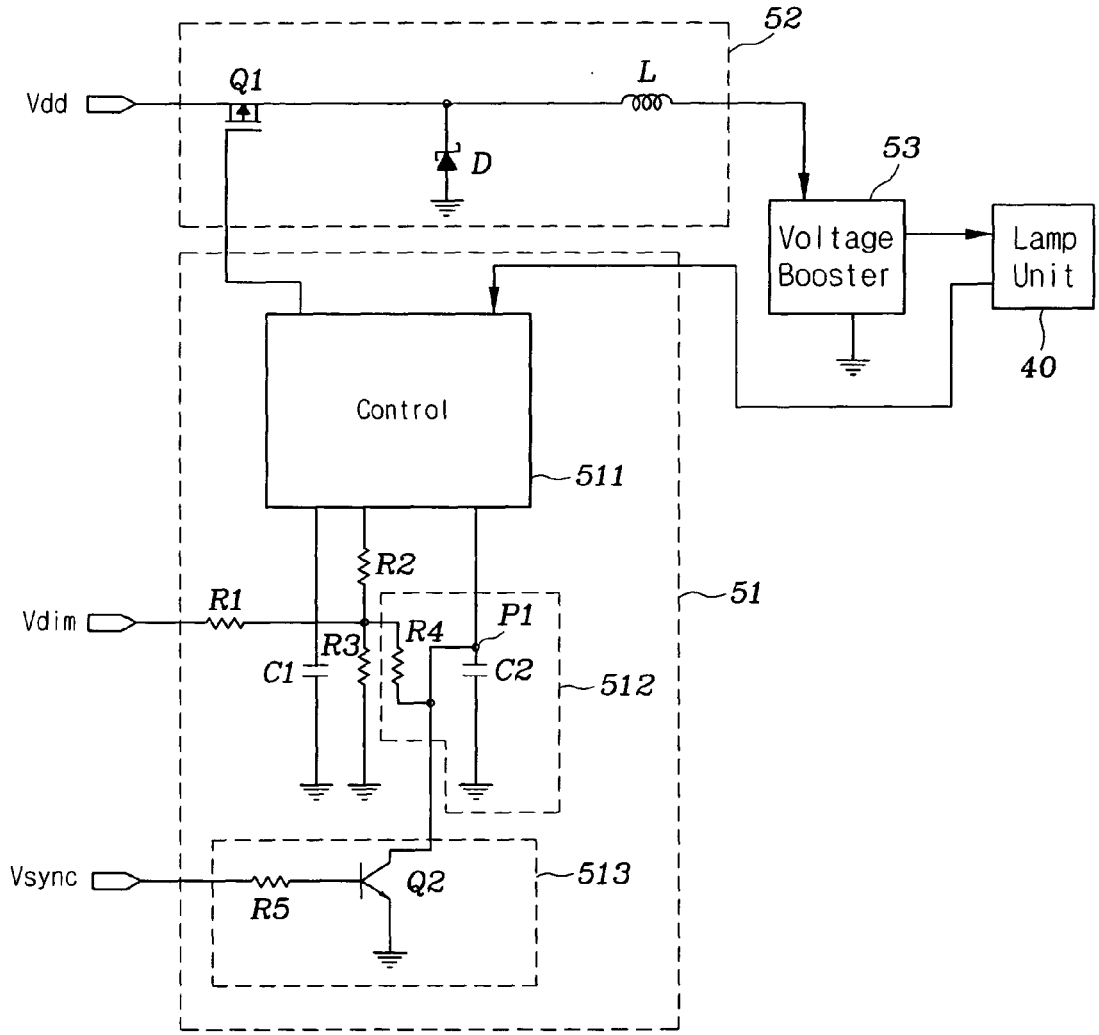
FIG. 5 is an exemplary circuit diagram of the inverter shown in FIG. 4.
Figure 6:
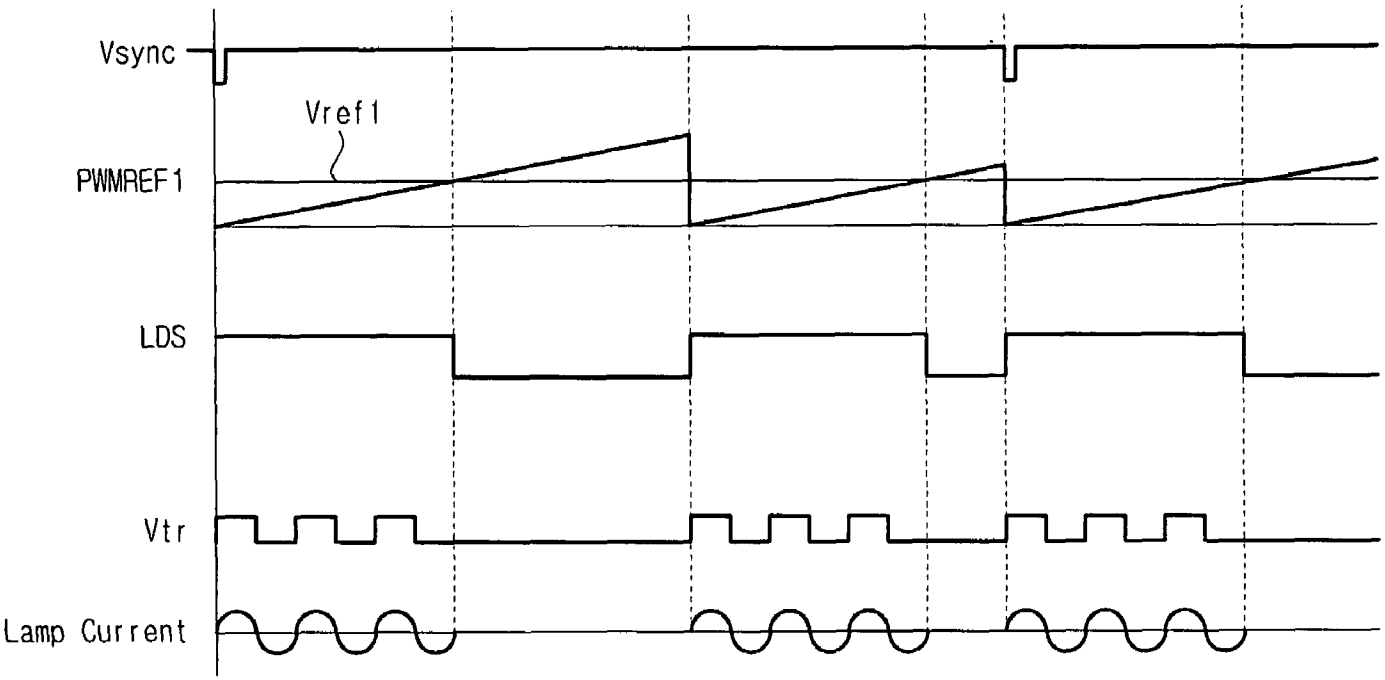
FIG. 6 shows waveforms of exemplary signals used in the inverter shown in FIG. 5.

FIG. 4 is a block diagram of an exemplary inverter for the LCD shown in FIG. 3, FIG. 5 is an exemplary circuit diagram of the inverter shown in FIG. 4, and FIG. 6 shows waveforms of exemplary signals used in the inverter shown in FIG. 5.

Referring to FIG. 4, an exemplary inverter 50 includes a voltage booster 53, a power driver 52, and an inverter controller 51 connected in sequence to a lamp unit 40.

Referring to FIG. 5, the voltage booster 53 is connected to a ground and includes a transformer (not shown) for boosting input voltage.

The power driver 52 includes a MOS (metal-oxide-silicon) transistor Q1 connected to a DC voltage Vdd, an inductive coil L connected between the transistor Q1 and the voltage booster 53, and a diode D connected in reverse direction from the transistor Q1 to the ground. The transistor Q1 is a power switching element for the DC voltage Vdd and the diode D and the inductor L are provided for noise removal and voltage stabilization.

The inverter controller 51 includes a control block 511, a time constant setting block 512, and an initiation block 513 connected in sequence to the transistor Q1 of the power driver 52, as well as a voltage divider including a pair of resistors R2 and R3 connected in series between the control block 511 and the ground, a capacitor C1 connected parallel to the voltage divider R2 and R2, and an input resistor R1 connected between the voltage divider R2 and R2 and a dimming signal Vdim.

The control block 511 is connected to a gate of the transistor Q1 of the power driver 52 and the lamp unit 40.

The time constant setting block 512 includes a resistor R4 and a capacitor C2 connected in series between the input resistor R1 and the ground, and a node P1 between the resistor R4 and the capacitor C2 is connected to the control block 511.

The initiation block 513 includes a bipolar transistor Q2 and an input resistor R5 connected between the vertical synchronization signal Vsync and the transistor Q2. The transistor Q2 includes a collector connected to the node P1 of the initiation block 513, an emitter connected to the ground, and a base connected to the input resistor R5. The input resistor R5 may be omitted.

An operation of the inverter 50 is now described in detail.

The control block 511 generates a pulse width modulation (PWM) carrier signal PWMBAS1 including a sawtooth wave or a triangular wave and the time constant setting block 512 determines the time constant of the carrier signal PWMBAS1. FIG. 6 shows a sawtooth wave.

The resistors R2 and R3 and the capacitor C1 connected to the control block 511 are provided for establishing an initial value, and a feedback signal from the lamp unit 40 to the control block 511 is a detection signal such as a lamp current for dimming control.

The control block 511 generates a lamp driving signal LDS by pulse width modulating a reference voltage Vref1 such as the dimming signal Vdim from an external circuit or a separate signal generated depending on the dimming signal Vdim based on the carrier signal PWMBAS1. For example, the control block 511 compares the reference signal Vref1 with the carrier signal PWMBAS1 and generates a PWM signal, i.e., the lamp driving signal LDS having a high value when the reference voltage Vref1 is larger than the carrier signal PWMBAS1 and a low value when the reference voltage Vref1 is smaller than the carrier signal PWMBAS1.

The transistor Q1 of the power driver 52 operates depending on the lamp driving signal LDS and generates an output signal Vtr. The transistor Q1 is toggled to alternately transmit the DC voltage Vdd such that the output signal Vtr alternately have two values during the on-time of the lamp driving signal LDS, while the transistor Q1 is inactive to make the output signal Vtr have a constant value during the off-time of the lamp driving signal LDS. As described above, the diode D and the inductor L remove the noise and stabilize the output voltage Vtr.

The voltage booster 53 is also toggled to generate a sinusoidal signal in response to the toggling of the output signal Vtr of the power driver 52 and boosting the voltage of the sinusoidal signal to a high voltage to be applied to the lamp unit 40. Then a lamp current is flowing to the lamp unit 40 in synchronization with the signal Vtr as shown in FIG. 6. However, the lamp current disappears when the signal Vtr has a constant value and there is no sinusoidal signal.

As a result, the lamp unit 40 is turned on during the on-time of the lamp driving signal LDS and turned off during the off-time of the lamp driving signal LDS.

In the meantime, a pulse of the vertical synchronization Vsync initiates the lamp driving signal LDS by the time constant setting block 512.

In detail, referring to FIGS. 5 and 6, the transistor Q2 of the initiation block 513 is turned on by the pulse of the vertical synchronization Vsync to make the voltage across the capacitor C2 of the time constant setting block 512 discharge and the voltage of the node P1 grounded. Therefore, the control block 511 initiates the generation of the carrier signal PWMBAS1 again. Accordingly, the pulse of the vertical synchronization Vsync resets the carrier signal PWMBAS1 to restart the on-time of the lamp driving signal LDS. That is, the vertical synchronization Vsync resets the lamp unit 40.

Figure 7:
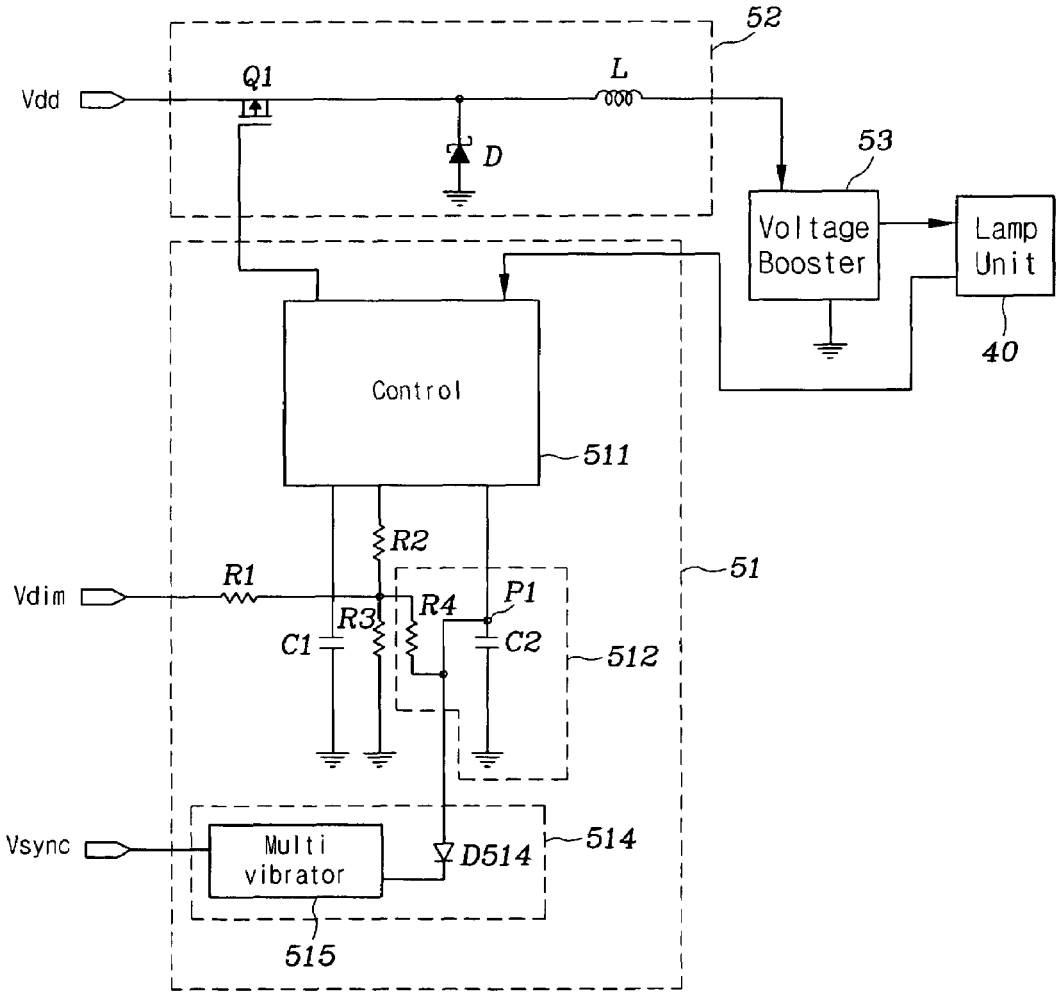
FIG. 7 is another exemplary circuit diagram of the inverter shown in FIG. 4.

FIG. 7 is another exemplary circuit diagram of the inverter shown in FIG. 4.

The exemplary circuit shown in FIG. 7 is similar to that shown in FIG. 5 except for an internal circuitry of an initiation block 514.

The initiation block 514 includes a multivibrator 515 and a diode D514 connected in reverse direction from the multivibrator 515 to a time constant setting block 512. The multivibrator 515 regulates the pulse width of the vertical synchronization Vsync, and the pulse of the regulated vertical synchronization Vsync turns on the diode D514 to pull down the voltage at a node P1 to a ground. The inverter shown in FIG. 7 reduces the pulse width of the vertical synchronization Vsync by the multivibrator 515, and is effective for reducing the duration of the ground value of the voltage at the node P1 to a predetermined time.

Now, an LCD and an inverter therefor according to another embodiment of the present invention are described in detail with reference to FIGS. 8-11.

Figure 8:
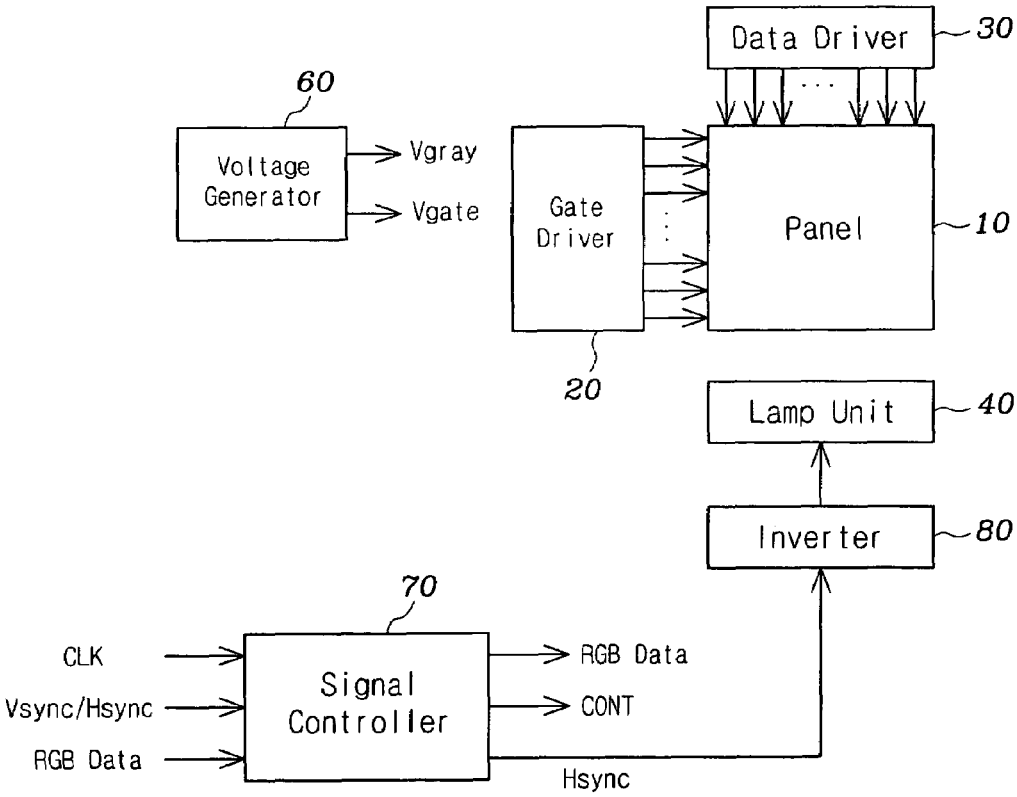
FIG. 8 is a block diagram of an LCD according to another embodiment of the present invention.

FIG. 8 is a block diagram of an LCD according to another embodiment of the present invention.

Referring to FIG. 8, an LCD according to another embodiment of the present invention includes a liquid crystal panel assembly 10, a gate driver 20, a data driver 30, a voltage generator 60, a lamp unit 40, an inverter 80, and a signal controller 70. A block configuration of the LCD shown in FIG. 8 is similar to that shown in FIG. 3 except that a horizontal synchronization signal Hsync other than a vertical synchronization Vsync and a dimming signal is input to the inverter 80.

Figure 9:
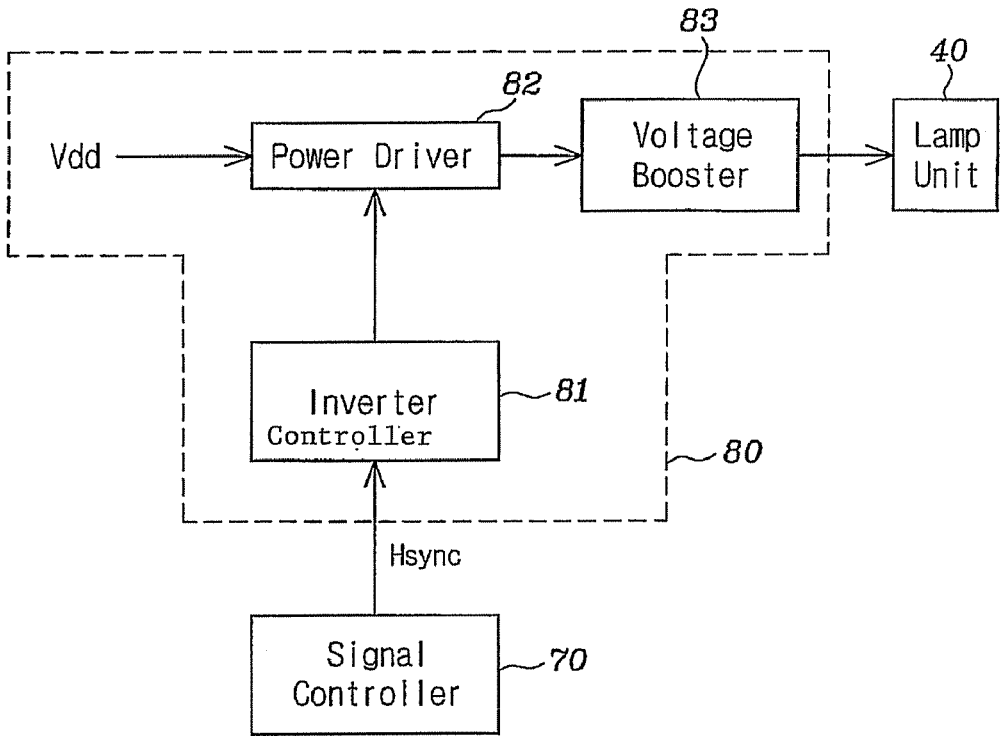
FIG. 9 is a block diagram of an exemplary inverter for the LCD shown in FIG. 8.
Figure 10:
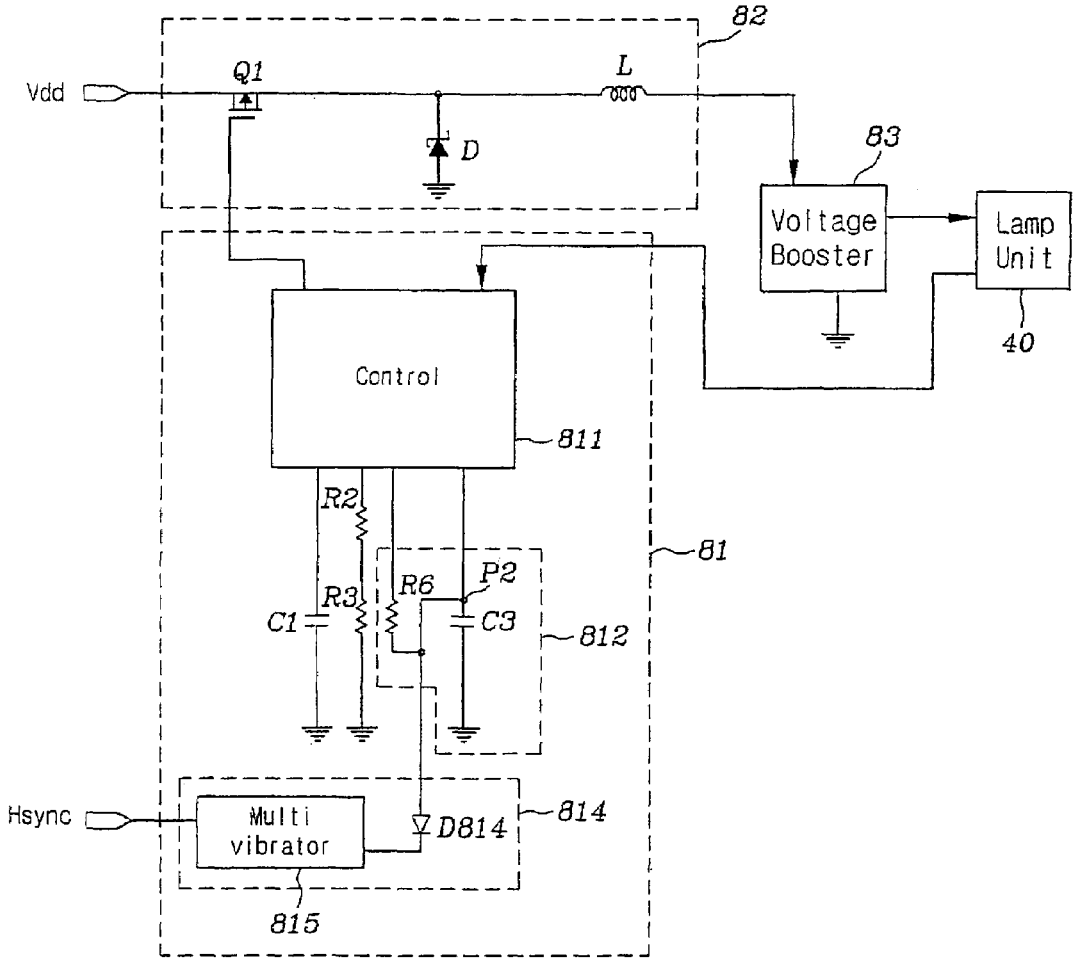
FIG. 10 is an exemplary circuit diagram of the inverter shown in FIG. 9.
Figure 11:
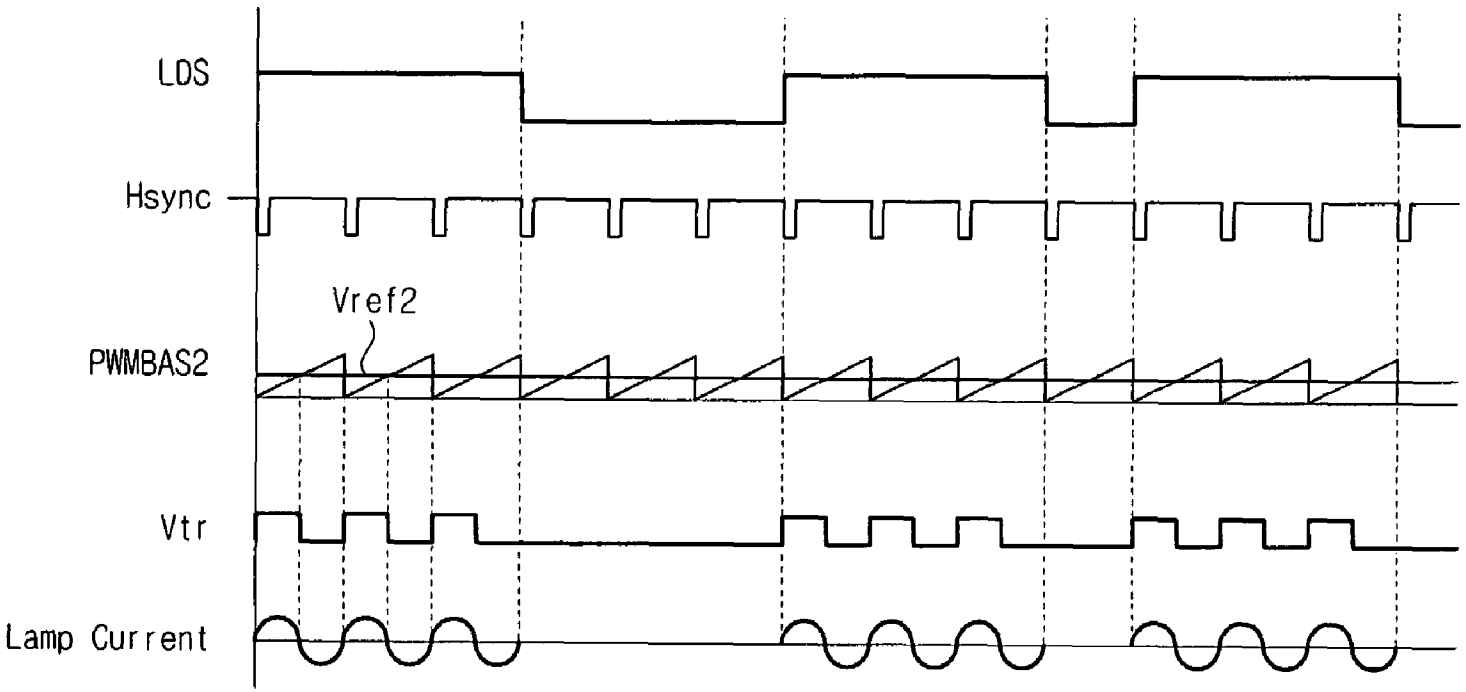
FIG. 11 shows waveforms of exemplary signals used in the inverter shown in FIG. 10.

FIG. 9 is a block diagram of an exemplary inverter for the LCD shown in FIG. 8, FIG. 10 is an exemplary circuit diagram of the inverter shown in FIG. 9, and FIG. 11 shows waveforms of exemplary signals used in the inverter shown in FIG. 10.

An exemplary inverter 80 shown in FIG. 9 includes a voltage booster 83, a power driver 82, and an inverter controller 81 connected in sequence to a lamp unit 40, and has a block configuration similar to that shown in FIG. 4, except that a horizontal synchronization signal Hsync other than a vertical synchronization Vsync and a dimming signal is input to the inverter controller 81.

Referring to FIG. 10, the inverter controller 81 includes a control block 811, a time constant setting block 812, and an initiation block 813 as well as a pair of resistors R2 and R3 connected in series between the control block 811 and the ground and a capacitor C1. The inverter controller 81 has a configuration similar to that 51 shown in FIG. 7 except for the time constant setting block 512, etc.

As shown in FIG. 10, an input resistor is omitted since there is no applied dimming signal, and a resistor R6 of the time constant setting block 812 is connected to the inverter controller 811 rather than to an input resistor. A capacitor of the time constant setting block 812 is represented by C3, and a multivibrator and a diode of the initiation block 814 are indicated by reference numerals 815 and D814.

An operation of the inverter 80 is now described in detail.

The control block 811 generates a PWM carrier signal PWMBAS2 including a sawtooth wave or a triangular wave and the time constant setting block 812 determines the time constant of the carrier signal PWMBAS2. FIG. 11 shows a sawtooth wave.

The control block 811 generates an oscillating signal by pulse width modulating a reference voltage Vref2 predetermined by a designer based on the carrier signal PWMBAS2. The transistor Q1 of the power driver 82 is toggled in response to the oscillating signal and generates an output signal Vtr.

Describing in detail with reference to FIG. 11, the horizontal synchronization signal Hsync is modified by the multivibrator 815 of the initiation block 814 such that its active low duration is decreased, that is, the horizontal synchronization signal Hsync is regulated. The pulse of the regulated horizontal synchronization Hsync turns on the diode D814 to make the voltage across the capacitor C3 of the time constant setting block 812 discharged and the voltage of a node P2 grounded. Therefore, the time constant given by the time constant setting block 812 is reset and the generation of the carrier signal PWMBAS2 is restarted.

As shown in FIG. 11, the carrier signal PWMBAS2 restarts whenever pulses of the horizontal synchronization signal Hsync are generated. Since a sinusoidal signal to be applied to the lamp unit 40 is generated in synchronization with the oscillating signal generated based on the carrier signal PWMBAS2, the lamp current flowing in the lamp unit 40 is synchronized with the horizontal synchronization signal Hsync.

In the meantime, the control block 811 generates a lamp driving signal LDS having on-time and off-time such that the signal Vtr and the lamp current have square waveform and sinusoidal waveform, respectively, during the on-time of the lamp driving signal LDS, while the signal Vtr has a constant value to make the lamp current disappear during the off-time of the lamp driving signal LDS.

Now, an LCD and an inverter therefor according to another embodiment of the present invention are described in detail with reference to FIGS. 12-14.

Figure 12:
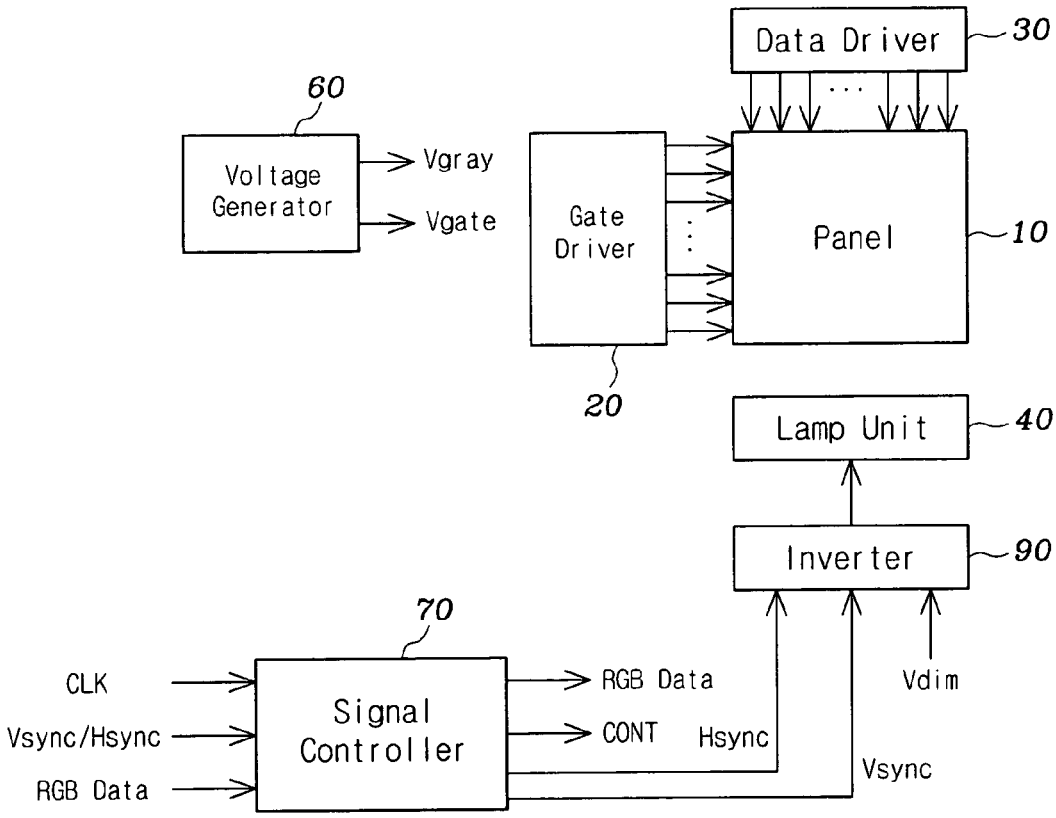
FIG. 12 is a block diagram of an LCD according to another embodiment of the present invention.

FIG. 12 is a block diagram of an LCD according to another embodiment of the present invention.

Referring to FIG. 12, an LCD according to another embodiment of the present invention includes a liquid crystal panel assembly 10, a gate driver 20, a data driver 30, a voltage generator 60, a lamp unit 40, an inverter 90, and a signal controller 70. A block configuration of the LCD shown in FIG. 11 is similar to that shown in FIGS. 3 and 8 except that a horizontal synchronization signal Hsync, a vertical synchronization Vsync, and a dimming signal Vdim are input to the inverter 90.

Figure 13:
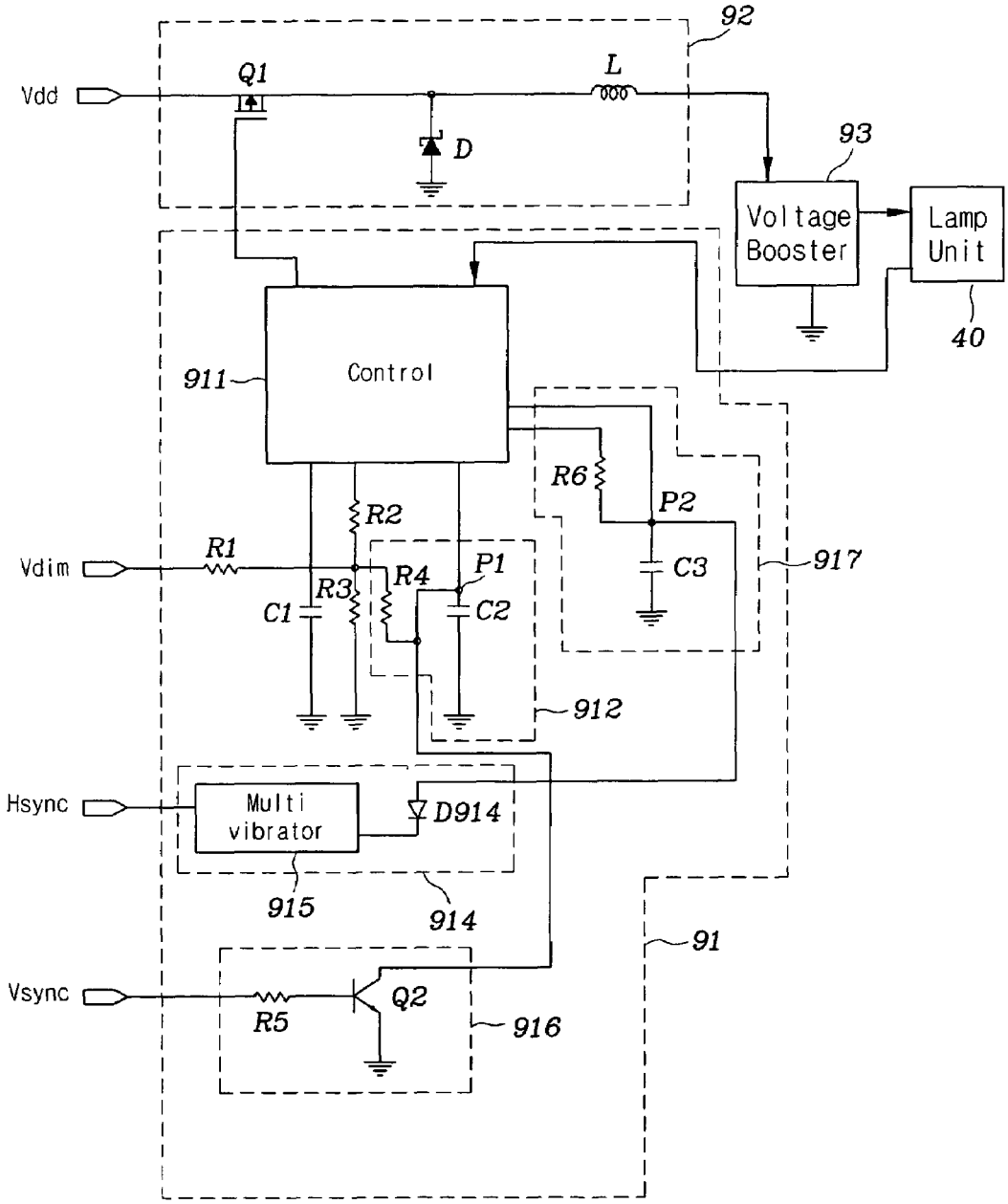
FIG. 13 is a circuit diagram of an exemplary inverter shown in FIG. 12.
Figure 14:
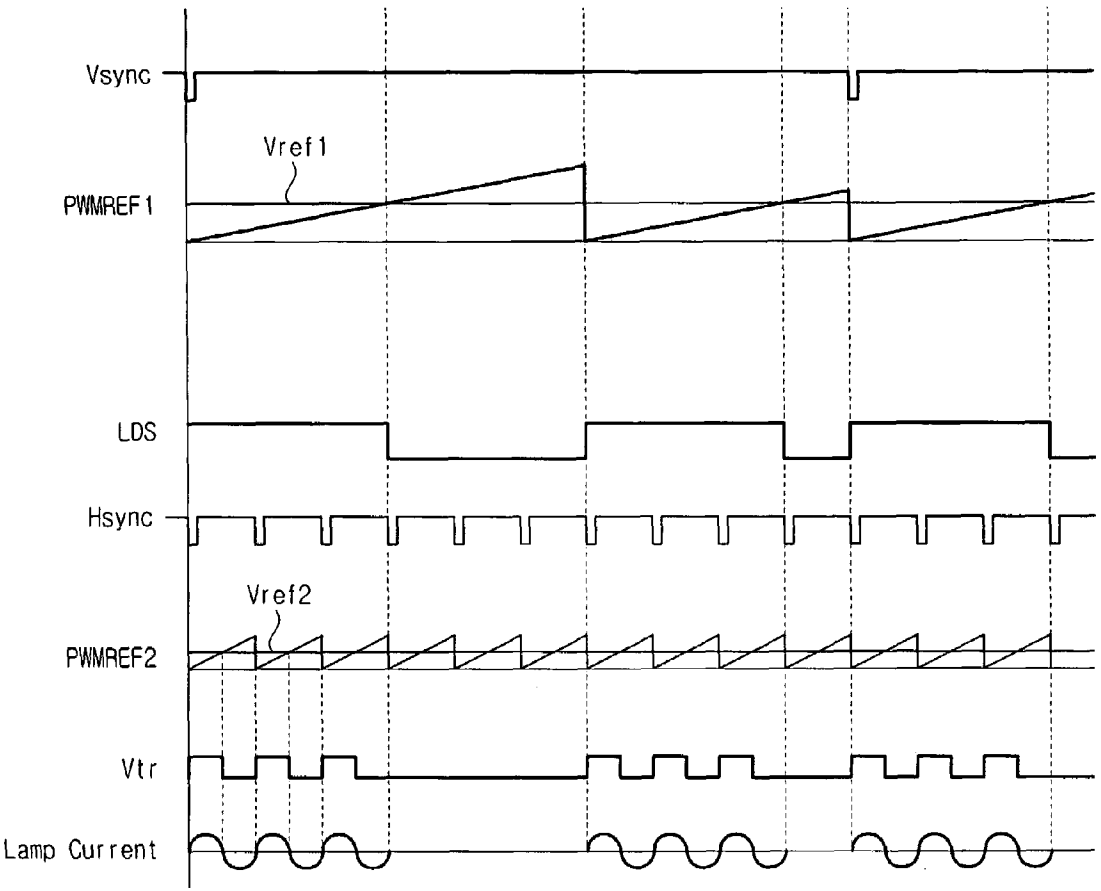
FIG. 14 shows waveforms of exemplary signals used in the inverter shown in FIG. 13.

FIG. 13 is a circuit diagram of an exemplary inverter shown in FIG. 12, and FIG. 14 shows waveforms of exemplary signals used in the inverter shown in FIG. 13.

An exemplary inverter 90 shown in FIG. 13 includes a voltage booster 93, a power driver 92, and an inverter controller 91 connected in sequence to a lamp unit 40.

The voltage booster 93 and the power driver 92 have configurations similar to the voltage boosters 53 and 83 and the power drivers 52 and 82 shown in FIGS. 5, 7 and 9.

Referring to FIG. 13, the inverter controller 91 includes a control block 911, first and second time constant setting blocks 912 and 917, and first and second initiation blocks 916 and 914 as well as a voltage divider including a pair of resistors R2 and R3 connected in series between the control block 911 and the ground, a capacitor C1 connected parallel to the voltage divider R2 and R3, and an input resistor connected between the voltage divider R2 and R3.

The first time constant setting block 912 and the first initiation block 916 have substantially the same configurations as the time constant setting block 512 and the initiation block 513 shown in FIG. 5, respectively, and the second time constant setting block 917 and the second initiation block 914 have substantially the same configurations as the time constant setting block 812 and the initiation block 814 shown in FIG. 10, respectively. A multivibrator and a diode of the second initiation block 914 are indicated by reference numerals 915 and D914.

Consequently, the configuration of the inverter controller 91 is substantially equal to a combination of the inverter controller 51 shown in FIG. 5 and the inverter controller 81 shown in FIG. 10, and thus the operation of the inverter controller 91 is substantially equal to a combination of the operations of the inverter controllers 51 and 81.

The operation of the inverter 90 is now described in detail.

The control block 911 generates PWM carrier signals PWMBAS1 and PWMBAS2 including sawtooth waves or triangular waves and the first and the second time constant setting block 912 and 917 determines the time constant of the first and the second carrier signals PWMBAS1 and PWMBAS2.

The control block 911 generates a lamp driving signal LDS by pulse width modulating a first reference voltage Vref1 such as the dimming signal Vdim from an external circuit or a separate signal generated depending on the dimming signal Vdim based on the carrier signal PWMBAS1. In addition, the control block 911 generates an oscillating signal by pulse width modulating a second reference voltage Vref2 predetermined by a designer based on the carrier signal PWMBAS2. The oscillating signal has a square waveform during the on-time of the lamp driving signal LDS shown in FIG. 14 and has a constant value during the off-time of lamp driving signal LDS. A transistor Q1 of the power driver 92 is toggled in response to the oscillating signal and generates an output signal Vtr.

Referring to FIGS. 13 and 14, the pulse of the vertical synchronization Vsync turns on a transistor Q2 of the first initiation block 916 and the first time constant setting block 912 initiates the first carrier signal PWMBAS1 and the lamp driving signal LDS, thereby restarting the oscillating signal and the signal Vtr. In addition, the horizontal synchronization signal Hsync is regulated by the multivibrator 915 of the second initiation block 914. The pulse of the regulated horizontal synchronization Hsync turns on the diode D914 to reset the time constant given by the time constant setting block 912, thereby restarting the second carrier signal PWMBAS2 to re-initiate the oscillating signal and the signal Vtr.

Consequently, the inverter 90 according to this embodiment initiates the lamp driving signal upon receipt of pulses of the vertical synchronization signal Vsync and synchronizes the oscillating signal with the pulses of the horizontal synchronization signal Hsync. Since the vertical synchronization signal Vsync has a frequency much smaller than the frequency of the horizontal synchronization signal Hsync such that a pulse of vertical synchronization signal Vsync is generated whilst hundreds or thousands of pulses of horizontal synchronization signal Hsync are generated, there is no interference or conflict between the pulses of the signals Vsync and Hsync.

To summarize, the sinusoidal signal starts in synchronization with the pulses of the vertical synchronization signal Vsync and has an oscillation timing synchronized with the frequency of the horizontal synchronization signal Hsync.

Now, an LCD and an inverter therefor according to another embodiment of the present invention are described in detail with reference to FIGS. 15-18.

Figure 15:
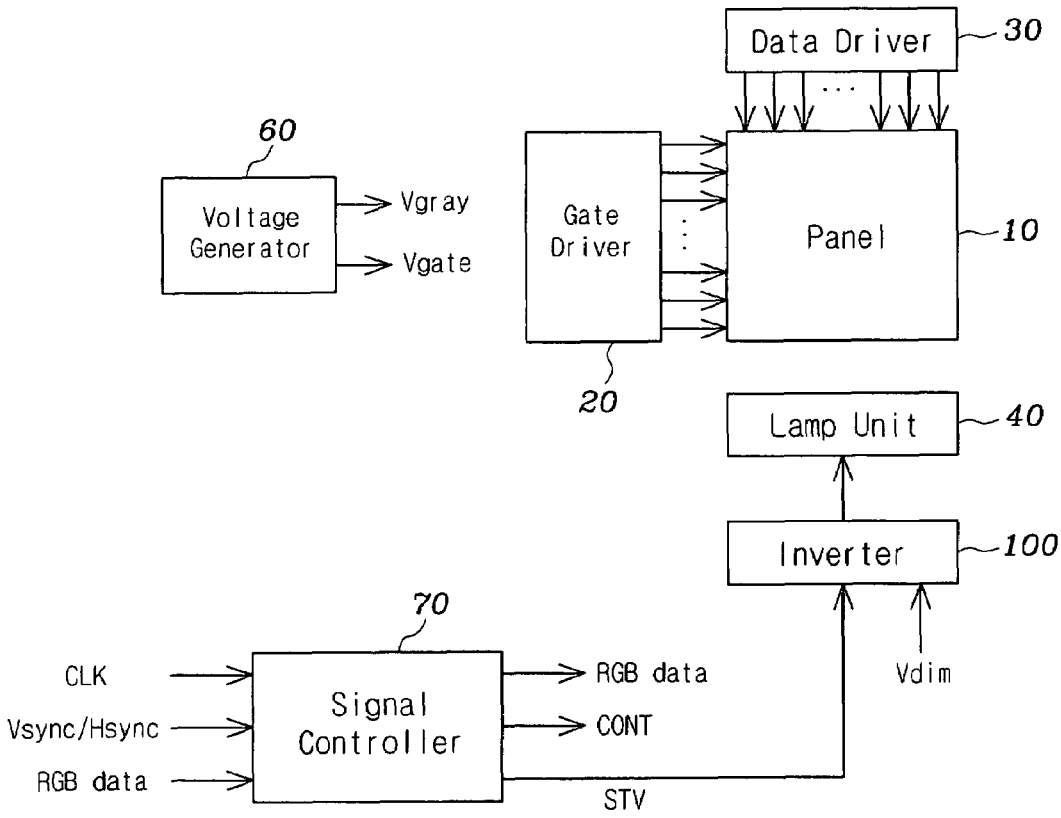
FIG. 15 is a block diagram of an LCD according to another embodiment of the present invention.

FIG. 15 is a block diagram of an LCD according to another embodiment of the present invention.

Referring to FIG. 15, an LCD according to another embodiment of the present invention includes a liquid crystal panel assembly 10, a gate driver 20, a data driver 30, a voltage generator 60, a lamp unit 40, an inverter 100, and a signal controller 70. A block configuration of the LCD shown in FIG. 15 is similar to that shown in FIG. 3 except that a vertical synchronization start signal STV and a dimming signal Vdim other than a vertical synchronization Vsync and a dimming signal are input to the inverter 100.

Figure 16:
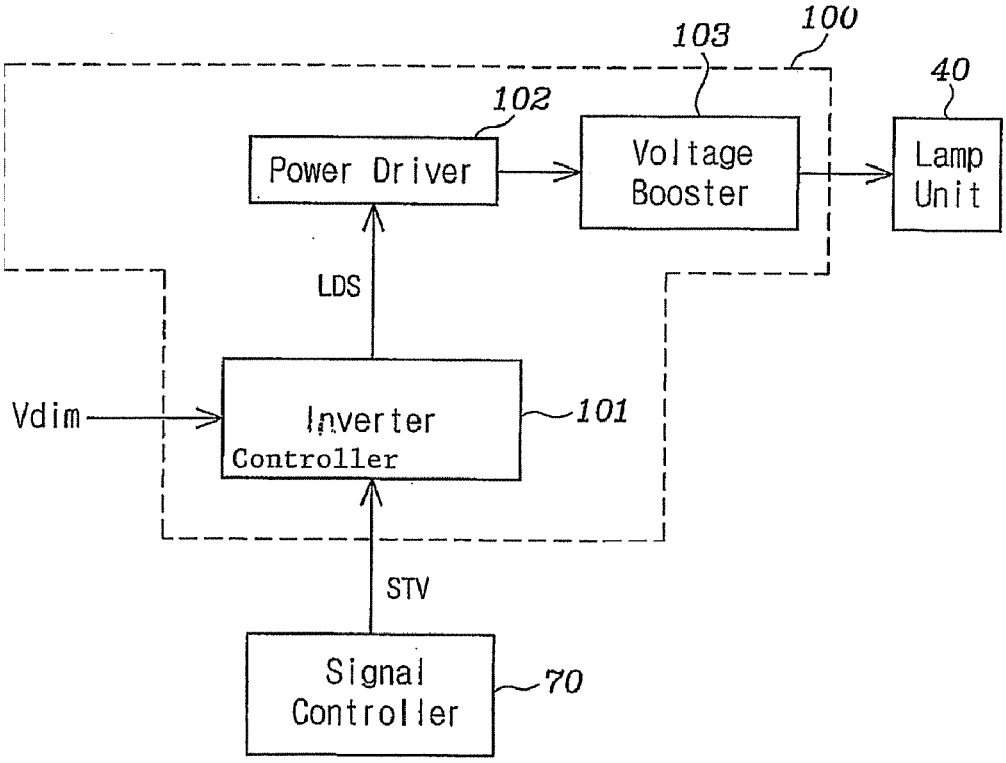
FIG. 16 is a block diagram of an exemplary inverter for the LCD shown in FIG. 15.
Figure 17:
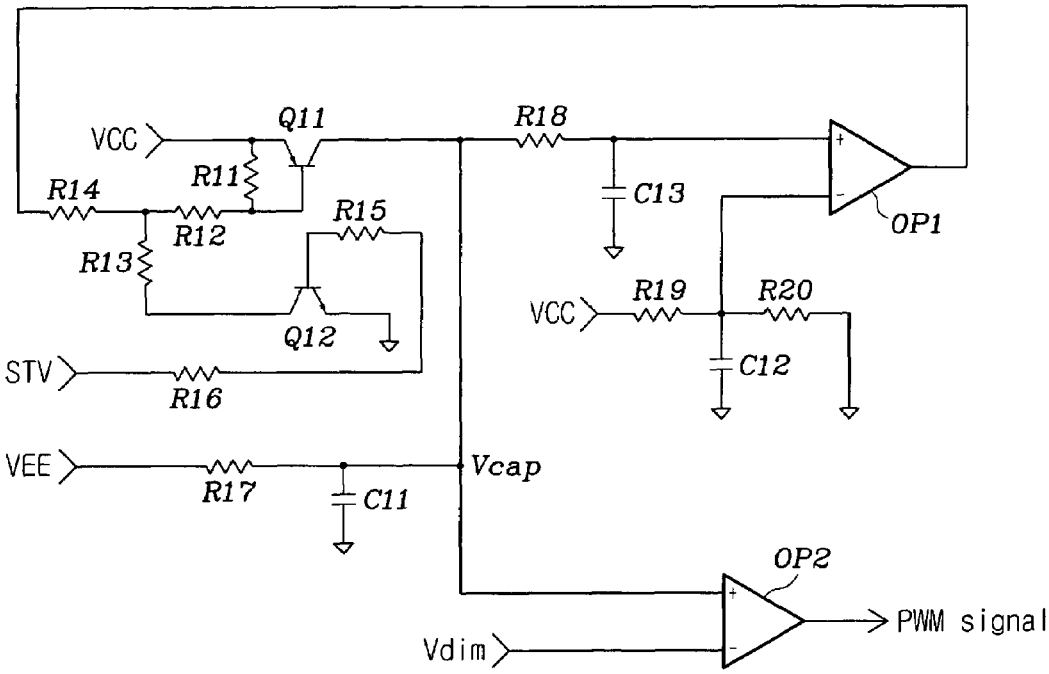
FIG. 17 is an exemplary circuit diagram of the inverter shown in FIG. 16.
Figure 18:
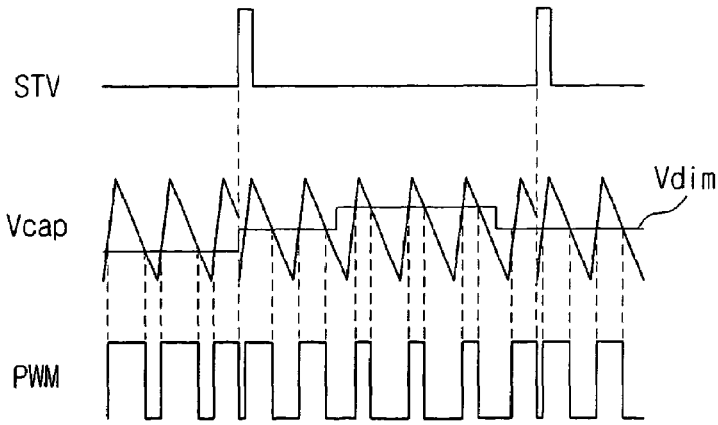
FIG. 18 shows waveforms of exemplary signals used in the inverter shown in FIG. 17.

FIG. 16 is a block diagram of an exemplary inverter for the LCD shown in FIG. 15, FIG. 17 is an exemplary circuit diagram of the inverter shown in FIG. 16, and FIG. 18 shows waveforms of exemplary signals used in the inverter shown in FIG. 17.

An exemplary inverter 100 shown in FIG. 16 includes a voltage booster 103, a power driver 102, and an inverter controller 101 connected in sequence to a lamp unit 40, and has a block configuration similar to that shown in FIG. 4, except that a vertical synchronization start signal STV and a dimming signal Vdim other than a vertical synchronization Vsync and a dimming signal are input to the inverter controller 101.

Referring to FIG. 17, the inverter controller 101 includes a pair of operational amplifiers OP1 and OP2 serving as comparators, a pair of bipolar transistors Q11 and Q12 serving as switching elements, a plurality of capacitors C11-C13, and a plurality of resistors R11-R20.

The transistor Q11, the operational amplifier OP1, and a capacitor C11 are provided for generating a triangular carrier wave, the transistor Q12 is provided for reset the generation of the triangular wave in response to the vertical synchronization start signal STV, and the operational amplifier OP2 is provided for generating a PWM signal by comparing the dimming signal Vdim with the triangular wave.

A supply voltage VCC is a positive voltage, while another supply voltage VEE is a negative voltage.

The transistor Q12 has a base connected to the vertical synchronization start signal STV via the resistors R15 and R16, an emitter connected to a ground, and a collector connected to the resistor R13. The transistor Q11 has a base connected to the emitter of the transistor Q12 via the resistors R12 and R13, an emitter connected to the supply voltage VCC, and a collector connected to the capacitor C11. The base and the emitter of the transistor Q11 are connected to each other via the resistor R11.

The capacitor C11 has a terminal connected to the supply voltage VEE via the resistor R17 and the other terminal connected to the ground, and generates an output voltage Vcap.

The operational amplifier OP2 has a noninverting terminal (+) connected to the output voltage Vcap of the capacitor C11 and an inverting terminal (−) receiving the dimming signal Vdim.

The operational amplifier OP1 has a noninverting terminal (+) connected to the output voltage Vcap of the capacitor C11 through an RC filter including the resistor R18 and the capacitor C13, and an inverting terminal (−) connected to a voltage divider including a pair of the resistors R19 and R20 connected between the supply voltage VCC and the ground as well as the capacitor C12 for noise removal. An output of the operational amplifier OP1 is input into the base of the transistor via the resistors R14 and R12.

Although the transistor Q11 is a pnp bipolar transistor and the transistor Q12 is an npn bipolar transistor, the types of the transistors Q11 and Q12 may be changed.

An operation of the inverter 100 is now described in detail.

When the transistor Q11 is turned on by an initial condition, the supply voltage VCC is applied to the capacitor C11 to be steeply charged such that the output voltage Vcap sharply increases. The operational amplifier OP1 compares the voltage Vcap dropped by the resistor R18 with a voltage at the inverting terminal, which is determined by the voltage divider R19 and R20, and generates a high value if the voltage Vcap increases to reach a value. The high value of the operational amplifier OP11 turns off the transistor Q11 and then the capacitor C11 discharges the voltage toward the negative supply voltage VEE through the resistor R17. If the output voltage Vcap of the capacitor C11 is reduced to reach a value, the operational amplifier OP1 outputs a low value to turn on the transistor Q11 again. In this way, the capacitor C11 repeats charging and discharging.

The output voltage Vcap of the capacitor C11 shown in FIG. 18 has a triangular waveform, which has a rising angle and a falling angle different from each other since the charging path and the discharging path are different.

In the meantime, the vertical synchronization start signal STV has a pulse every frame as shown in FIG. 18. The pulse of the vertical synchronization start signal STV turns on the transistor Q12 and then the base of the transistor Q11 is supplied with the ground voltage via the resistors R13 and R12. Accordingly, the transistor Q11 turns on to provide the supply voltage VCC to the capacitor C11. As a result, the capacitor C11 begins to be charged and to generate a triangular output voltage Vcap whenever the pulses of the vertical synchronization start signal STV are input.

The operational amplifier OP2 compares the output voltage Vcap of the capacitor C11 with the dimming signal Vdim. The operational amplifier OP2 outputs a high value when the dimming signal Vdim is lower than the voltage Vcap, while it outputs a low value when the dimming signal Vdim is higher than the voltage Vcap. In this way, a lamp driving signal PWM having on/off duty ratio depending on the dimming signal Vdim is obtained by the operational amplifier OP2 and synchronized with the vertical synchronization start signal STV.

As described above, a lamp driving signal according to the embodiments of the present invention is synchronized with a vertical synchronization signal or a vertical synchronization start signal, and a sinusoidal signal applied to a lamp unit is synchronized with a horizontal synchronization signal. These synchronizations reduce beating and horizontal stripes.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An inverter for a liquid crystal display, the inverter comprising:

an inverter controller generating a carrier signal for pulse width modulation and a lamp driving signal having on-time and off-time by pulse width modulating a dimming signal based on the carrier signal and controlling the on-time of the lamp driving signal in response to at least one of a vertical synchronization signal and a vertical synchronization start signal;

a power switching element selectively transmitting a DC voltage in response to a signal from the inverter controller; and a voltage booster for driving a lamp in response to a signal from the switching element;

wherein the inverter controller includes a control block which generates the carrier signal and the lamp driving signal, a time constant setting block which determines a time constant of the carrier signal, and an initiation block which resets the time constant given by the time constant setting block whenever pulses of the vertical synchronization signal are generated.

2. The inverter of claim 1, wherein the liquid crystal display comprises a signal controller for providing the vertical synchronization signal and the vertical synchronization start signal and the dimming signal is provided from the signal controller or an external device.

3. The inverter of claim 1, wherein the time constant setting block comprises a resistor and a capacitor connected between the dimming signal and a ground and provides a signal at a node between the resistor and the capacitor to the control block.

4. The inverter of claim 3, wherein the initiation block comprises a transistor having a collector connected to the node between the resistor and the capacitor of the time constant setting block, a grounded emitter, and a based supplied with the vertical synchronization signal via a resistor, the transistor turned on by the pulses of the vertical synchronization signal.

5. An inverter for a liquid crystal display, the inverter comprising:

an inverter controller generating a carrier signal for pulse width modulation and a lamp driving signal having on-time and off time by pulse width modulating a dimming signal based on the carrier signal and controlling the on-time of the lamp driving signal in response to at least one of a vertical synchronization signal and a vertical synchronization start signal, wherein the inverter controller comprises a control block for generating the first and the second carrier signals, the lamp driving signal, and the oscillating signal, first and second time constant setting blocks for determining time constant of the first and the second carrier signal, a first initiation block for resetting the time constant given by the first time constant setting block whenever pulses of the vertical synchronization signal are generated, and a second initiation block for resetting the time constant given by the second time constant setting block whenever pulses of the horizontal synchronization signal are generated;

a power switching element selectively transmitting a DC voltage in response to a signal from the inverter controller; and a voltage booster for driving a lamp in response to a signal from the switching element.

6. The inverter of claim 5, wherein the first time constant setting block comprises a resistor and a capacitor connected between the dimming signal and a ground and provides a signal at a node between the resistor and the capacitor to the control block as the first carrier signal.

7. The inverter of claim 6, wherein the first initiation block comprises a transistor having a collector connected to the node between the resistor and the capacitor of the time constant setting block, a grounded emitter, and a based supplied with the vertical synchronization signal via a resistor, the transistor turned on by the pulses of the vertical synchronization signal.

8. The inverter of claim 5, wherein the second time constant setting block comprises a resistor and a capacitor connected in series and provides a signal at a node between the resistor and the capacitor to the control block as the second carrier signal.

9. The inverter of claim 8, wherein the initiation block comprises a multivibrator regulating pulse width of the horizontal synchronization signal and a diode connected in reverse direction from the multivibrator to the node between the resistor and the capacitor of the time constant setting block, the diode turned on by the pulses of the horizontal synchronization signal.

* * * * *